United States Patent [19]

Ledsham

[11] Patent Number: 4,628,007

[45] Date of Patent: Dec. 9, 1986

[54] TRASH BAG INSERT

[76] Inventor: Paul Ledsham, 361 Sandford Street, Newmarket, Ontario, Canada, L3Y 4S2

[21] Appl. No.: 569,725

[22] Filed: Jan. 10, 1984

[51] Int. Cl.[4] ..... B65D 5/56

[52] U.S. Cl. ..... 428/542.8; 141/390; 220/1 T; 220/62; 220/403; 229/5.5; 428/906

[58] Field of Search ..... 220/403, 62, 1 T; 229/5.5; 206/217, 218; 141/316, 390; 428/12, 542.8, 906; 53/390

[56] References Cited

U.S. PATENT DOCUMENTS

| | | | |
|---|---|---|---|
| 1,916,519 | 7/1933 | Madsen et al. | 229/5.5 X |
| 1,947,835 | 2/1934 | Dubbs | 220/403 |
| 2,433,945 | 1/1948 | Foreman | 220/403 X |
| 2,568,664 | 9/1951 | Scott | 229/5.5 UX |
| 2,673,024 | 3/1954 | Kuss | 220/403 X |
| 3,232,469 | 2/1966 | Piazze | 428/542.8 X |
| 3,822,524 | 7/1974 | Jerpbak | 53/390 X |
| 3,901,431 | 8/1975 | Carlson | 229/5.5 X |
| 3,930,607 | 1/1976 | Smith | 229/5.5 X |
| 3,983,914 | 10/1976 | Benson | 53/390 X |
| 4,014,157 | 3/1977 | Pearce | 53/390 X |
| 4,037,778 | 7/1977 | Boyle | 53/390 X |
| 4,115,909 | 9/1978 | Corella | 428/57 X |
| 4,238,541 | 12/1980 | Burton | 428/906 X |
| 4,359,076 | 11/1982 | Kyte | 53/390 X |
| 4,380,686 | 4/1983 | Moisson | 428/464 X |
| 4,462,536 | 7/1984 | Junge et al. | 229/5.5 |

FOREIGN PATENT DOCUMENTS 986896 4/1976 Canada .

*Primary Examiner*—Henry F. Epstein

[57] ABSTRACT

An insert for holding open and supporting in a generally upright position a trash bag not capable of self-support is disclosed. The insert is a generally rectangular member which is rollable on itself. The rectangular member has resiliency characteristics such that it tends to unroll when rolled upon itself. The member is sized such that when it is rolled upon itself and inserted within the trash bag it unrolls until restrained by the bag and therefore the bag is held open and supported in a generally upright position.

6 Claims, 7 Drawing Figures

TRASH BAG INSERT

FIELD OF THE INVENTION

This invention relates to an insert for holding open and supporting in a generally upright position a trash bag not capable of self-support such as a plastic garbage bag.

BACKGROUND OF THE INVENTION

Trash bags such as plastic garbage bags have become extremely popular for the retention and disposal of garbage from the kitchen, workshop, yard or otherwise. However, since these bags are constructed of a thin plastic film, they are not capable of self-support and must therefore be held open and supported by hand when refuse is being disposed of therein or provided with some sort of container to hold the bag.

Conventionally the bag is inserted within a container such as a plastic or metal pail sized appropriately to contain the bag and its contents when full. The top of the bag is usually folded over the upper edge of the container to maintain the bag in its position and after the bag is full of trash or refuse the bag and its contents must be removed from the container. Often this proves difficult since the bag and its contents have settled into contact with the container thereby hampering removal of the bag from the container. Furthermore, if sharp objects were disposed of, the bag itself might have become torn on its sides thereby permitting the exit of refuse or trash from the bag after removal from the container.

Canadian Letters Pat. No. 986,896 which issued to Jerpbak on Apr. 6, 1976, discloses a device and method for facilitating the filling of a flexible trash bag. An elongate sheet of slippery material, such as plastic, is provided with two cooperating sets of securing apertures. The sheet is formed into a cylindrical open ended body and secured in that shape by means of fastener elements passed through the apertures in the sheet. At at least one end of the sheet there are several columns of apertures so that the sheet may be formed into a number of sizes for various sizes of bags. The sheet, after having been rolled into a cylindrical shape of a desired circumference is secured by means of the fasteners and apertures and inserted within a trash bag. The cylindrical shape is intended to be slid up in the bag as the bag is filled and to be removed from the bag before the bag and its contents are sealed in readiness for disposal.

It will be appreciated that since trash bags come in many different sizes it is necessary to adjust and secure the Jerpack arrangement prior to insertion within the bag. In practice the circumference of the cylindrically shaped body would have to be somewhat less than the circumference of the trash bag to allow insertion therein.

The insert of this invention for holding open and supporting in a generally upright position a trash bag not capable of self-support comprises a generally rectangular member which is rollable on itself. The member has resiliency characteristics such that the member tends to unroll when rolled upon itself. The member is sized such that when it is rolled upon itself and inserted within a trash bag the member unrolls until restrained by the bag and thus the bag is held open and supported in a generally upright position.

The insert of this invention does not require the securing of the sheet by means of fasteners and apertures to form a cylindrical shape of fixed circumference. Rather the rectangular member is simply rolled upon itself and inserted within the bag. Since the member has resiliency characteristics such that it tends to unroll the member will unroll within the bag until it is restrained by the bag thereby completely opening the bag and allowing 100% utilization of the bag. The insert of this invention is obviously simpler to use since there is no need to determine what circumference the bag has and form the member into a fixed cylindrical shape by means of apertures and fasteners before insertion within the bag.

According to an aspect of the invention the insert may be a sheet of relatively inexpensive cardboard having a thickness of approximately one millimeter. The cardboard insert may be disposed of along with the bag due to its low cost and if this is done there is no need to be concerned with removing the insert from the trash bag prior to sealing up the bag in readiness for disposal.

DESCRIPTION OF THE DRAWINGS

These and other features and other advantageous of the invention will become apparent to those skilled in the art in the following detailed description of the invention which is shown in the accompanying drawings wherein.

DETAILED DESCRIPTION OF THE PREFERRED EMBODIMENTS OF THE INVENTION

Figure 1:
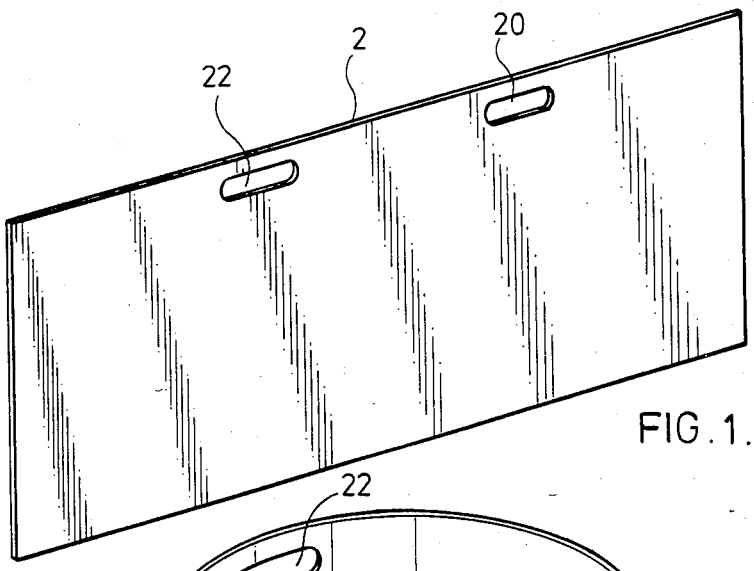
FIG. 1 is a plane view of the generally rectangular member before it is rolled on itself.

With reference to FIG. 1 a generally rectangular member 2 is shown in the unrolled position. The member 2 should have resiliency characteristics such that when the member is rolled upon itself it tends to unroll. The member may be made of a plastic material or may be a sheet of cardboard. Cardboard of a thickness of approximately 1 millimeter has been found to provide sufficient resiliency such that the member will unroll after having been rolled upon itself.

It would be appreciated that there are many sizes of trash bags ranging from relatively small bags that might be used in the washroom of a home to large bags that might be used in the yard of a property for the collection of leaves or the like. An insert sized for a very small bag would be inappropriate for a very large bag, however, one size of insert will suffice for many sizes of bags of the same general size. The height of the member 2 should be somewhat less than the height of the bag which is to be supported and the length of the member should be in excess of the circumference of the bag being supported. If the length of the member is less than the circumference of the bag to be supported the bag will still be supported, however, there will be an area of the bag that is not lined with the insert. In general it is intended that the total interior sidewall of the bag be lined with the insert as the insert prevents sharp trash from tearing the sidewall of the bag when the bag is being filled. It is intended that the height of the insert be substantially equal to the height of the bag so that there is no need to slide the insert upwardly as the bag is filled with trash.

Figure 2:
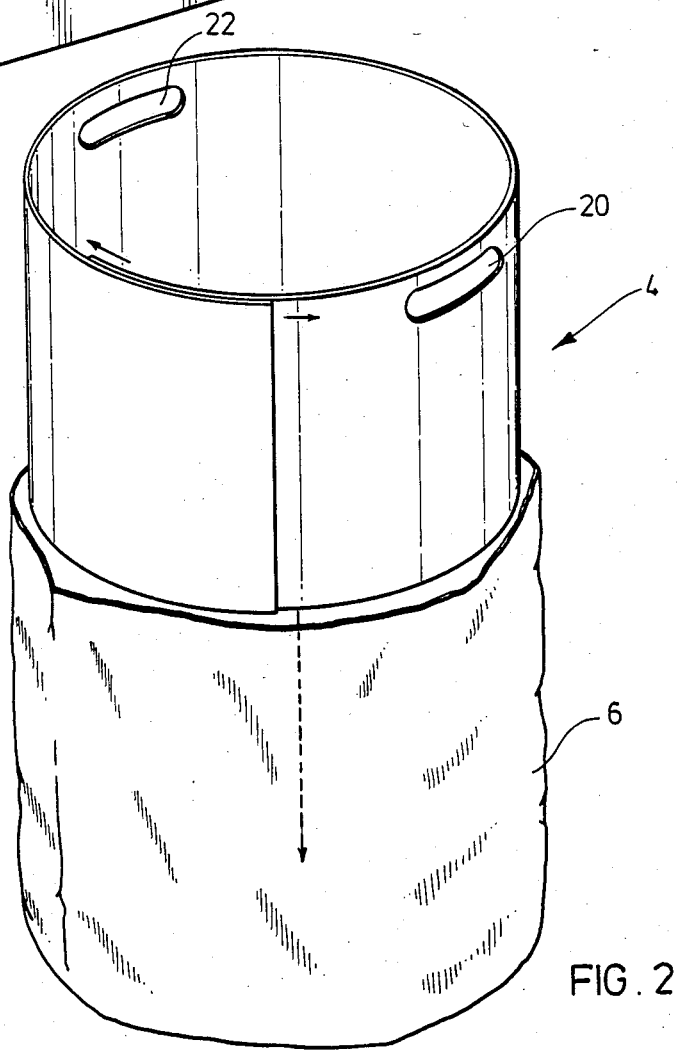
FIG. 2 is a perspective view of the rectangular member rolled upon itself and being inserted within a trash bag.

With reference to FIG. 2 the rectangular member is shown generally at 4 rolled upon itself and partially inserted in a trash bag 6. It should be noted that at the stage of inserting the rolled member into the bag the circumference of the rolled member can be significantly less than the circumference of the bag thereby permitting easy insertion.

Figure 3:
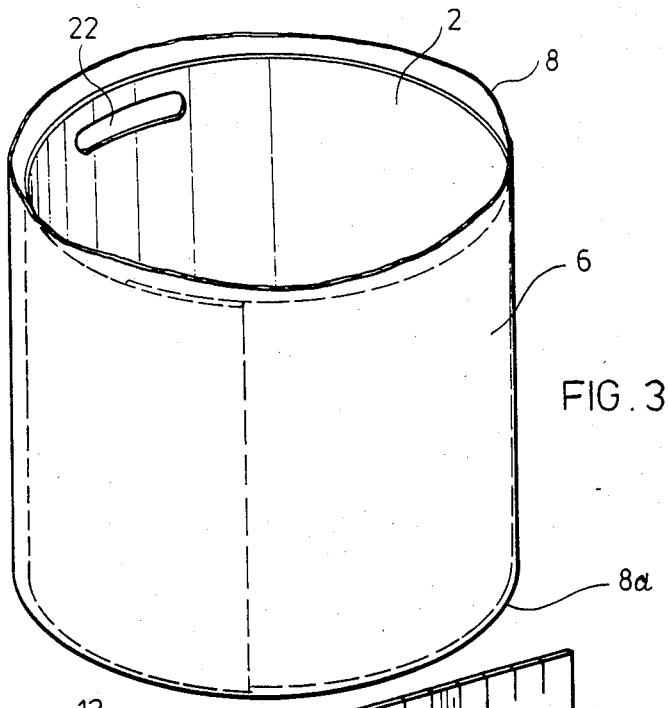
FIG. 3 is a perspective view of the trash bag held open and supported in a generally upright position by the insert.

With reference to FIG. 3 the member 2 that has been inserted within the bag has been allowed to unroll until restrained by the bag. The bag will be held open by the rolled member 2 which has unrolled until restrained by the bag. It should be appreciated that the bag is 100% distended and thus the bag can be fully utilized. The top portion of the bag will be free as shown at 8. It should be noted that the bag will not be required to be folded over the top edge of the insert, as is the case when the bag is supported within a container, since the pressure exerted on the bag as the insert unrolls within the bag is sufficient to maintain the bag in an upright position.

Since the insert comprises a generally rectangular member 2 rolled upon itself the bag is well supported in a generally upright position due to the generally flat bottom portion 8*a* of the member 2 when rolled upon itself. The bag is also held open in its maximum position since the rectangular member has unrolled or expanded to the maximum circumference of the bag 6.

The insert within the bag prevents tearing of the bag on the insertion of sharp articles or refuse. Therefore, lighter and cheaper bags may be used than would be otherwise advisable without the use of the insert. The insert may be removed from the bag prior to sealing up the bag for disposal or the insert may remain in the bag for disposal along with the refuse. In the case where the insert is to be removed from the bag for use with another bag the insert may be constructed of a plastic material so that it may be washed before reuse. Removal of the insert from the bag may be effected by simply lifting the insert upwardly thereby allowing the trash within the bag to come in contact with the wall of the bag.

If the insert is to be disposable it may be made of a sheet of relatively inexpensive cardboard. In this case the bag is simply sealed up with the insert remaining in the bag. The insert naturally toughens the wall of the bag and aids in the moving of the bag to its place of disposal.

The insert may be treated with suitable chemicals to repel pests which otherwise may be tempted to tamper with the bag. The insert may also be treated with a deodorant so that obnoxious smells of refuse may be minimized. These treatments of the rectangular member are especially advantageous in the case of cardboard sheet inserts.

Figure 4:
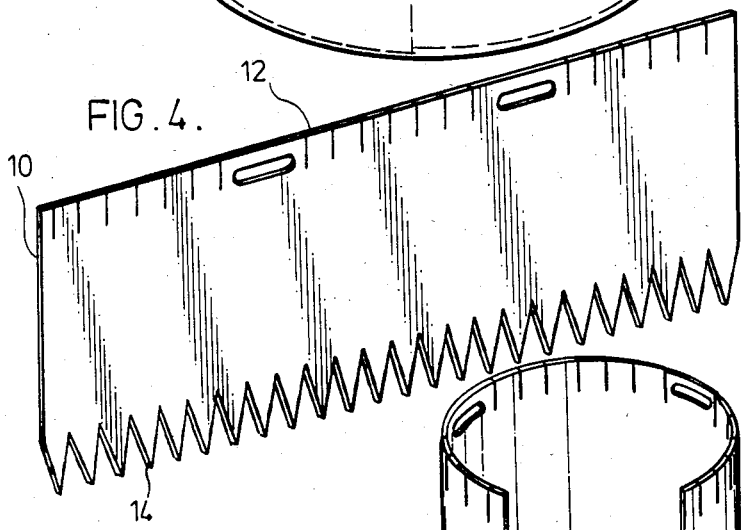
FIG. 4 is a plane view of the rectangular member with vertical cuts on the upper edge and serrated cuts on the lower edge.
Figure 5:
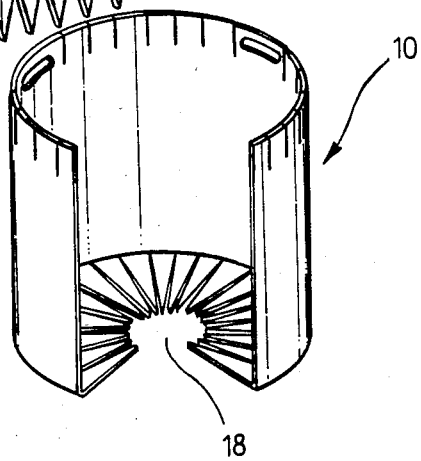
FIG. 5 is a perspective view of the rectangular member shown in FIG. 4 partially rolled on itself with the bottom portion of the member collapsed inwardly to form a bottom to the insert.

With reference to FIGS. 4 and 5 an alternate embodiment of the insert is shown. Along the upper edge of the insert 10 are provided vertical cuts 12 which are simply cuts in the sheet approximately two inches deep and spaced apart approximately one inch. Along the lower edge of the insert 10 are provided serrations 14. The depth of the serrations should be approximately equal to the radius of the insert after it is unrolled within the trash bag. As such, the serrations will form together to form essentially a bottom to the insert thereby protecting the bottom of the bag from sharp material. The angle of the serrations should be such that when the insert has unrolled within the bag there is little or no overlap between each serration. The number of serrations should be sufficient so that roundness of the insert may be maintained when it is rolled upon itself but not so great a number as to provide undue cluttering. In FIG. 5, the insert 10 is partially rolled upon itself with the bottom portion of the insert 10 collapsed in at 18 to form a bottom to the insert. This bottom 18 proves advantageous as a liner to the bottom of the bag in the case of heavy loads of refuse. The upper edge of the cardboard is vertically cut which allows, in the case of a disposable insert, the collapsing inwardly of the top of the rolled cardboard upon sealing of the bag.

Apertures 20 and 22 may be provided towards the top of the rectangular member 2. These apertures should be of the size of which a hand may pass through and provide convenient handling apertures to facilitate movement of the bag and insert. Even after the bag is sealed up with the insert remaining therein apertures 20 and 22 provide convenient carrying handles. Further, in the case of a reusable insert the apertures aid in removing the insert from the bag.

Figure 6:
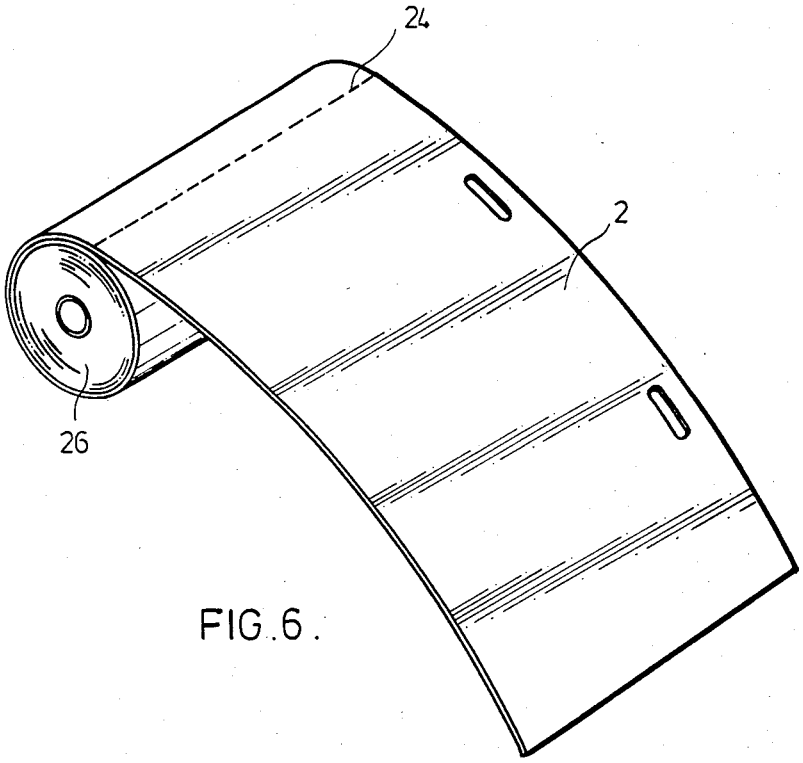
FIG. 6 is a perspective view of a series of inserts rolled upon themselves to form a shipping and handling package.
Figure 7:
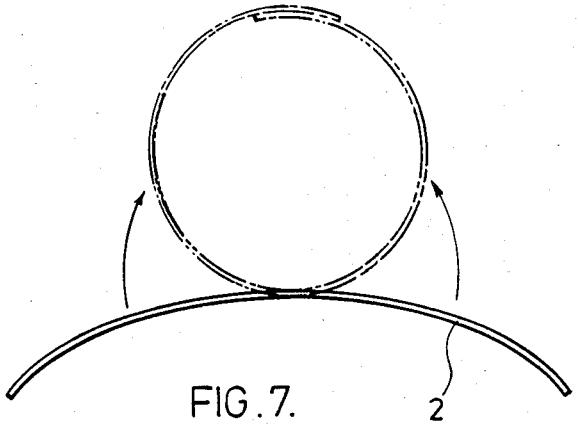
FIG. 7 is a cross-sectional view of an insert removed from the shipping and handling package.

In the case of disposable cardboard inserts a series of separable inserts may be jointed together by perforated edges 24 as shown in FIG. 6 and rolled upon themselves to form a shipping and handling package 26. When one desires to use a new insert it is a simple matter of unrolling the package and separating the insert 2 from the roll 26 along the perforated edge 24. Since the cardboard sheet 2 has come off the roll 26 it will tend to have a curvature associated with it as shown in FIG. 7 and the cardboard may be rolled in opposition to this curvature, as shown in dot in FIG. 7, thereby increasing the tendancy of the member to unroll when inserted within the bag. Although various preferred embodiments of the invention have been described here in detail it would be appreciated by those skilled in the art that variances may be made thereto without departing from the spirit of the invention or the scope of the intended claims.

The embodiments of the invention in which an exclusive property or privilege is claimed are defined as follows:

1. An insert for holding open and supporting in a general upright position a trash bag not capable of self-support, said insert comprising a generally rectangular member which is rollable under pressure upon itself for fitting within the trash bag and having resiliency characteristics and a thickness to resist such rolling with opposing outer edges of said insert being free to allow rolling and unrolling of said insert such that upon releasing the pressure, said member springs open and automatically unrolls in a generally circular configuration until restrained by the bag, thereby holding the bag open and supported in a generally upright position, said insert having a plurality of bottom edge serrations providing generally triangular bottom portions foldable inwardly to form a bottom end of said insert, said bottom portions being free of one another such that said bottom end is adjustable with unrolling of said insert to the size of the bag.

2. An insert as claimed in claim 1, wherein said bottom end is generally free of overlap between said triangular portions when unrolled within the garbage bag.

3. An insert as claimed in claim 1 wherein the member is a sheet of cardboard.

4. An insert as claimed in claim 1 wherein the thickness of the cardboard is approximately one millimeter.

5. An insert as claimed in claim 3 wherein the upper edge of the cardboard is provided with vertical cuts thereby allowing the collapsing inwardly of the top of the rolled cardboard upon sealing of the bag.

6. An insert as claimed in claim 5 wherein the serrations are spaced apart approximately one inch and are approximately two inches deep.

* * * * *